US007334879B2

(12) United States Patent
Takahashi

(10) Patent No.: US 7,334,879 B2
(45) Date of Patent: Feb. 26, 2008

(54) INK-JET HEAD

(75) Inventor: Yoshikazu Takahashi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 363 days.

(21) Appl. No.: 11/084,650

(22) Filed: Mar. 18, 2005

(65) Prior Publication Data

US 2005/0206681 A1 Sep. 22, 2005

(30) Foreign Application Priority Data

Mar. 18, 2004 (JP) ..... 2004-079020

(51) Int. Cl.
*B41J 2/045* (2006.01)

(52) U.S. Cl. ..... 347/68; 347/71; 347/65

(58) Field of Classification Search ..... 347/54, 347/63, 65, 67–68, 70–72
See application file for complete search history.

(56) References Cited

U.S. PATENT DOCUMENTS 6,059,395 A * 5/2000 Takata et al. ..... 347/15
6,736,493 B2 * 5/2004 Sekiguchi ..... 347/71
6,886,924 B2 * 5/2005 Hasenbein et al. ..... 347/76

FOREIGN PATENT DOCUMENTS

| | | |
|---|---|---|
| JP | 58-104289 | 1/1983 |
| JP | 10202921 | 8/1998 |
| JP | 2003-19796 | 1/2003 |

* cited by examiner

*Primary Examiner*—Juanita D. Stephens
(74) *Attorney, Agent, or Firm*—Reed Smith LLP

(57) ABSTRACT

An ink-jet head comprises an ink chamber, a pressure chamber, an actuator, a constriction, and a nozzle. The ink chamber contains ink. To the pressure chamber, ink is supplied from the ink chamber. The actuator is applied with a drive pulse to thereby change the pressure of ink in the pressure chamber. The constriction is disposed between the ink chamber and the pressure chamber and has a passage width narrower than that of the pressure chamber. The nozzle communicates with the pressure chamber and ejects ink in association with the pressure change of the ink in the pressure chamber. A ratio Ra/Rb between a flow resistance Ra of the constriction and a flow resistance Rb of the nozzle is 0.48 to 1.26.

8 Claims, 9 Drawing Sheets

INK-JET HEAD

BACKGROUND OF THE INVENTION

1. Field of the Invention

The present invention relates to an ink-jet head that conducts recordings by ejecting ink to a recording medium, and more specifically to an ink-jet head in which a constriction whose passage width is narrower than that of a pressure chamber is formed between an ink chamber and the pressure chamber and which changes the pressure of ink in the pressure chamber so that the ink is ejected through a corresponding nozzle.

2. Description of Related Art

Ink-jet heads employed in ink-jet printers or the like, include one which has an ink chamber for containing ink, pressure chambers supplied with ink from the ink chamber, nozzles communicating with the respective pressure chambers, and which changes the pressure of ink in the pressure chambers so that the ink is ejected through the nozzles. In such a head, provided is an actuator applied with a drive pulse to thereby change the pressure of ink in the pressure chambers, which is a known technique.

Recent years see a demand for high-speed and high-quality printings, and various techniques have been proposed in order to realize such printings. In an example of such techniques, in an ink-jet head having the aforementioned structure, a flow resistance throughout an ink passage and a flow resistance of a constriction formed between the ink chamber and the pressure chamber are brought into focus, and a ratio between these two flow resistances is kept within a predetermined range in order to avoid spoiling ejection stability even in a high-speed printing (see U.S. Pat. No. 6,736,493).

However, speed and quality of printings become higher and higher today, and therefore there arises a need to develop an ink-jet head capable of such a higher-speed and higher-quality printing. In the ink-jet head having the aforementioned structure, particularly, it is required that stable ejection is maintained even if a frequency of the drive pulse that is applied to the actuator is variously changed or a temperature environment where the head is used is variously changed.

SUMMARY OF THE INVENTION

An object of the present invention is to provide an ink-jet head that maintains stable ejection even if a frequency of a drive pulse applied to an actuator is variously changed or a temperature environment where the head is used is variously changed.

Experiments carried out under various conditions by the present inventor has revealed that constructions of a constriction and a nozzle have a great influence on ejection stability and that the aforesaid object can be accomplished when a ratio between a flow resistance of the constriction and a flow resistance of the nozzle is set within a predetermined range.

According to a first aspect of the present invention, there is provided an ink-jet head comprising an ink chamber, a pressure chamber, an actuator, a constriction, and a nozzle. The ink chamber contains ink. To the pressure chamber, ink is supplied from the ink chamber. The actuator is applied with a drive pulse to thereby change the pressure of ink in the pressure chamber. The constriction is disposed between the ink chamber and the pressure chamber and has a passage width narrower than that of the pressure chamber. The nozzle communicates with the pressure chamber and ejects ink in association with the pressure change of the ink in the pressure chamber. A ratio Ra/Rb between a flow resistance Ra of the constriction and a flow resistance Rb of the nozzle is 0.48 to 1.26.

In this ink-jet head, since the ratio between the flow resistance Ra of the constriction and the flow resistance Rb of the nozzle falls within the aforesaid range, stable ejection can be realized even if the drive pulse applied to the actuator adopts various frequencies and the head is used under various temperature environments.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
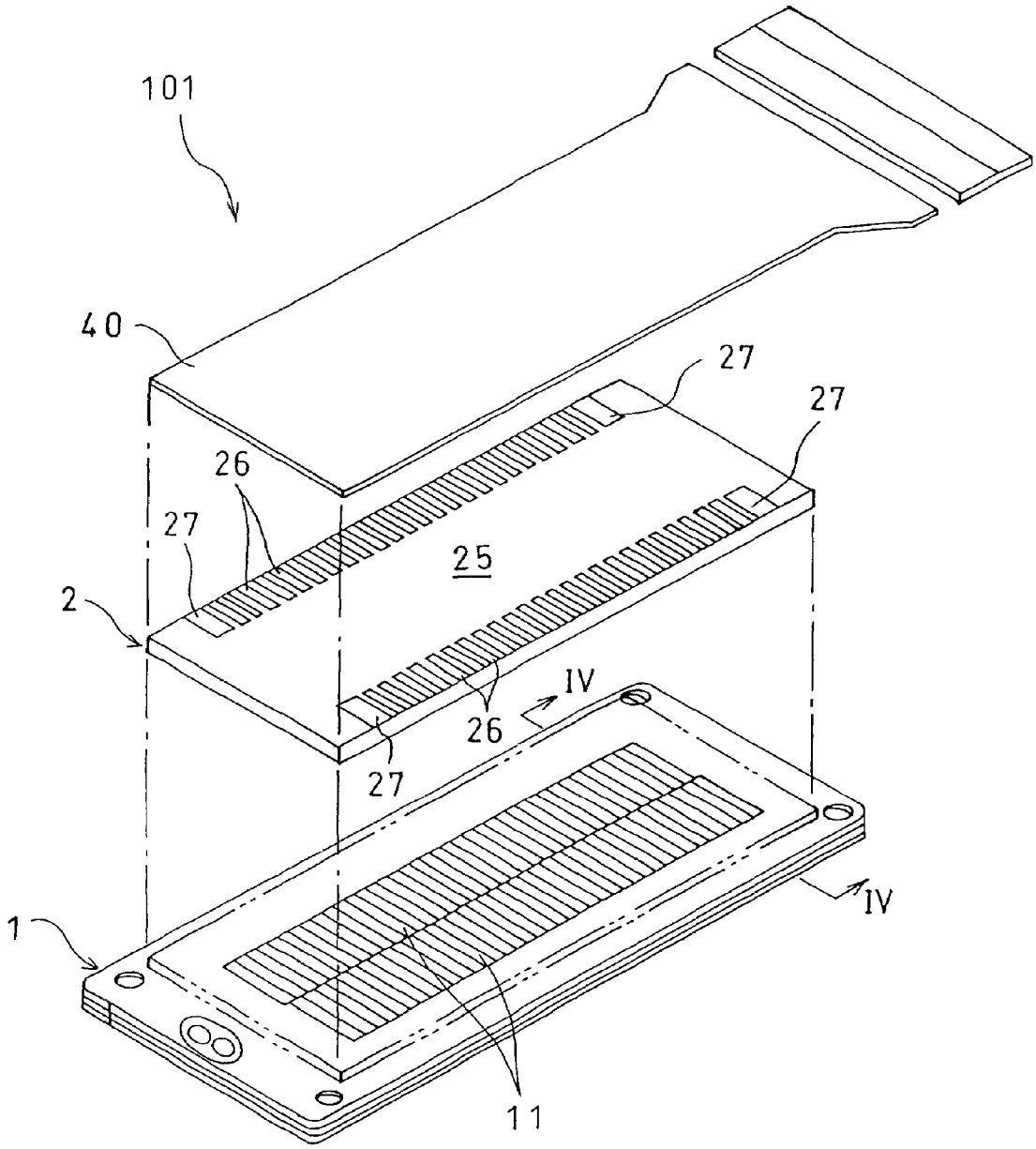
FIG. 1 is an exploded perspective view of an ink-jet head according to an embodiment of the present invention.

Referring to FIG. 1, first, a description will be given to a general construction of an ink-jet head according to an embodiment of the present invention. An ink-jet head 101 of this embodiment, which is used in an ink-jet printer that conducts recordings by ejecting ink to a paper as a record medium having been conveyed, comprises a passage unit 1, an actuator unit 2 bonded onto the passage unit 1, and a flexible printed circuit (FPC) 40 bonded onto the actuator unit 2. The FPC 40 is connected to a driver IC 50 (see FIG. 4), and transmits to the actuator unit 2 drive signals outputted from the driver IC 50.

Figure 2:
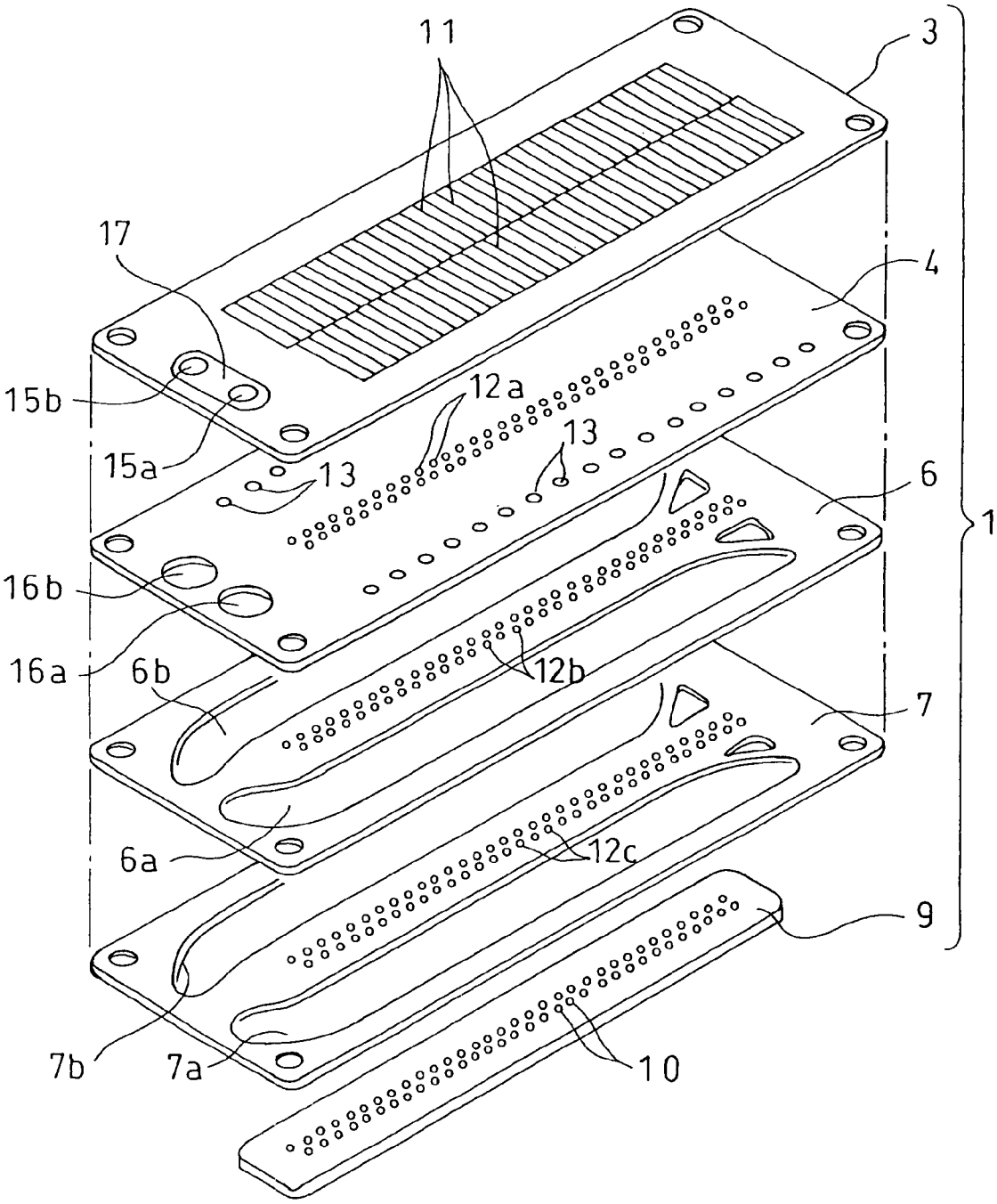
FIG. 2 is an exploded perspective view of a passage unit that is included in the ink-jet head of FIG. 1.
Figure 3:
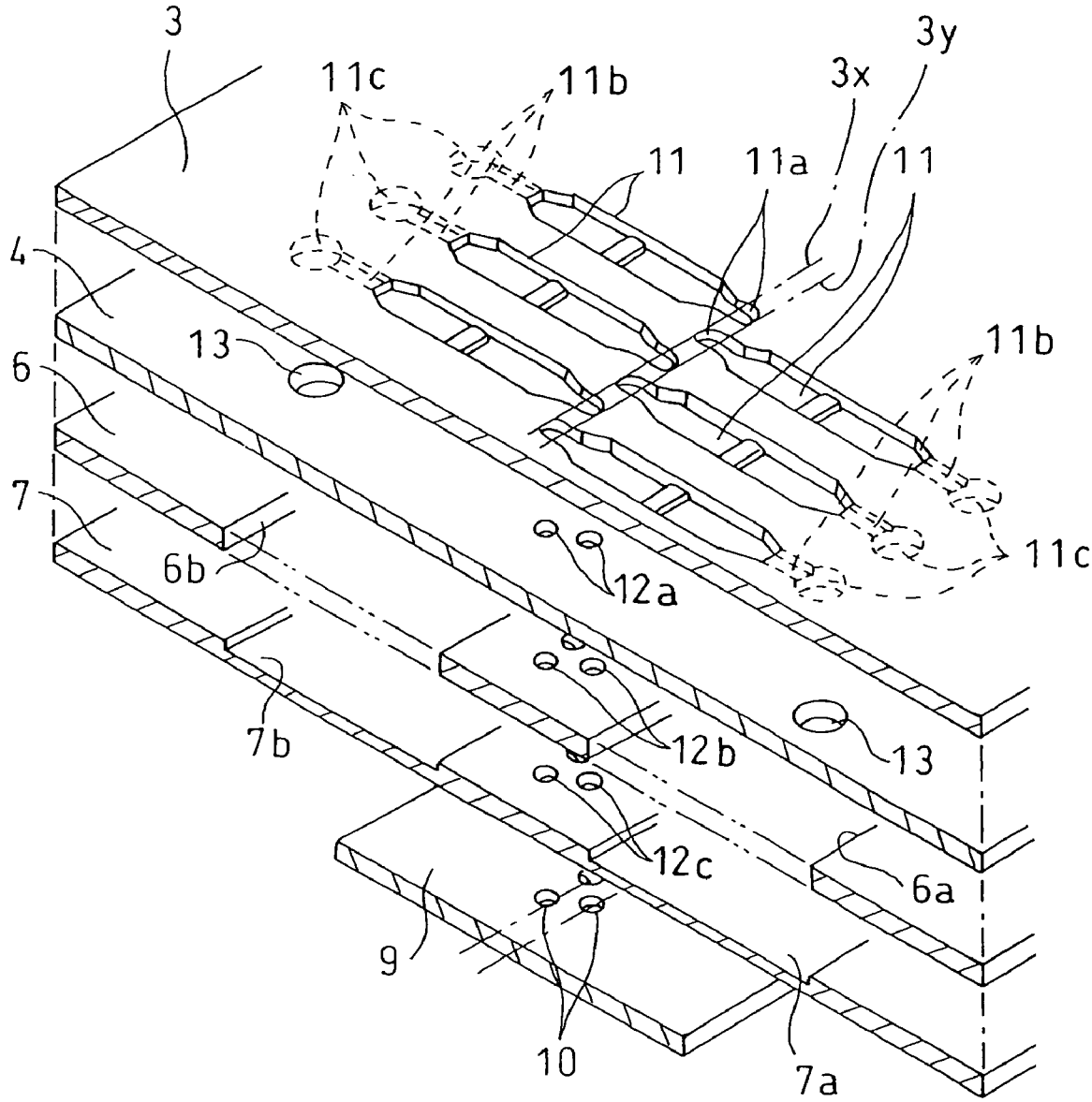
FIG. 3 is a local enlarged perspective view of the passage unit of FIG. 2.

Here will be detailed the passage unit 1 with reference to FIGS. 2 and 3.

The passage unit 1 has a layered structure of five plate-shaped materials in total, i.e., a cavity plate 3, a base plate 4, manifold plates 6 and 7, and a nozzle plate 9. Each of the plates 3, 4, 6, 7, and 9 is made of a 42% nickel alloy steel and has a substantially rectangular shape and a thickness of approximately 50 μm to 150 μm. Each of the plates 3, 4, 6, 7, and 9 has a large number of openings or recesses formed therein by means of press working or etching process. An adhesive is applied to planar regions of the plates 3, 4, 6, 7, and 9 which are thereby bonded to one another such that the openings or recesses may communicate with one another.

Formed in the cavity plate 3 are a large number of pressure chambers 11 which are provided at a distance from one another and arranged in two rows on opposite sides of a longitudinal center line of the plate 3. The pressure chambers 11 formed by a press-working penetrate the cavity plate 3 in its thickness direction. Each of the pressure chambers 11 has a substantially rectangular shape in a plan view, and disposed with its longer axis being in parallel with a shorter axis of the cavity plate 3. When reference lines 3*x* and 3*y* (see FIG. 3) are defined on opposite sides of the center line that extends along a longitudinal direction of the cavity plate 3 such that they can be in parallel with the center line, the pressure chambers 11 in the left-side row have their one longitudinal ends aligned along the right-side reference line 3*y*, and the pressure chambers 11 in the right-side row have their one longitudinal ends aligned along the left-side reference line 3*x*. In this state, in addition, longitudinal axes of pressure chambers 11 in one row alternate with longitudinal axes of pressure chambers 11 in the other row. In other words, the pressure chambers 11 are arranged in a zigzag pattern.

As shown in FIG. 3, one end 11*a* of each pressure chamber 11 near the center of the cavity plate 3 communicates with a nozzle 10 via small-diameter holes 12*a*, 12*b*, and 12*c*. The small-diameter holes 12*a*, 12*b*, and 12*c* are formed in a zigzag pattern in the base plate 4, manifold plate 6, and manifold plate 7, respectively. The nozzles 10 are similarly formed in the nozzle plate 9 in a zigzag pattern. On the other hand, the other end of each pressure chamber 11 communicates with manifolds 6*a*, 7*a* and 6*b*, 7*b* via a constriction 11*b*, a recess 11*c*, and a hole 13. Only a lower face of the cavity plate 3 is recessed through a half-etching process, etc., so that the constrictions 11*b* and the recesses 11*c* are opened in the face. The holes 13 are formed in the base plate 4, and the manifolds 6*a*, 6*b* and 7*a*, 7*b* are formed in the manifold plates 6 and 7, respectively.

As shown in FIG. 3, a width of the constriction 11*b* is smaller than that of the pressure chamber 11, and therefore a passage width of the constriction 11*b* is smaller than that of the pressure chamber 11. A ratio Ra/Rb between a flow resistance Ra of the constriction 11*b* and a flow resistance Rb of the nozzle 10 is 0.48 to 1.26, preferably 0.63 to 1.05, and more preferably 0.8 to 1.0, which will be detailed later. Since the constriction 11*b* has been formed through the half-etching process as mentioned above, the constriction 11*b* having the aforesaid flow resistance Ra can efficiently be formed at a low cost.

As shown in FIG. 2, a recess 17 having a substantially elliptic shape is formed near one longitudinal end of the cavity plate 3. In a plan view, the recess 17 is elongated along a widthwise direction of the cavity plate 3. Formed in a bottom of the recess 17 are two ink supply holes 15*a* and 15*b* that are disposed side by side along the widthwise direction of the cavity plate 3. A filter (not illustrated) is provided on an upper face of each of the ink supply holes 15*a* and 15*b*. The filter serves to remove dust that may be contained in ink supplied from an ink tank (not illustrated).

Formed in the base plate 4 are a large number of holes 12*a* that are arranged in two rows on opposite sides of a longitudinal center line of the base plate 4. The holes 12*a* are, similarly with the pressure chambers 11, arranged in a zigzag pattern. The base plate 4 has, near its both widthwise ends, many holes 13 are aligned along the longitudinal direction of the base plate 4. Two ink supply holes 16*a* and 16*b* are formed at portions of the base plate 4 corresponding to the ink supply holes 15*a* and 15*b* of the cavity plate 3. The ink supply holes 16*a* and 16*b* are somewhat larger than the ink supply holes 15*a* and 15*b*.

Formed in the manifold plate 6 are a large number of holes 12*b* that correspond to the holes 12*a* formed in the base plate 4. The holes 12*b* are arranged in two rows on opposite sides of a longitudinal center line of the manifold plate 6. Manifold channels 6*a* and 6*b* are formed near both widthwise ends of the manifold plate 6 so that they extend along a longitudinal direction of the manifold plate 6.

The manifold plate 7 has holes 12*c* and manifold channels 7*a*, 7*b*. The holes 12*c* are the same as the holes 12*b* of the manifold plate 6. Only an upper face of the manifold plate 7 is recessed through a half-etching process, etc., so that the manifold channels 7*a* and 7*b* are opened in the upper face. In a plan view, the manifold channels 7*a* and 7*b* have the same shape and the same location as those of the manifold channels 6*a* and 6*b* formed in the manifold plate 6.

In a plan view, one ends of the manifold channels 6*a* and 7*a* overlap the ink supply hole 16*a* of the base plate 4, and one ends of the manifold channels 6*b* and 7*b* overlap the ink supply hole 16*b* of the base plate 4. The manifold channels 6*a*, 7*a* and 6*b*, 7*b* extend in areas that include the two rows of holes 13 formed in the base plate 4. The manifold plates 6 and 7 are put in layers in a vertical direction and bonded to each other, to thereby form two ink chambers, i.e., the manifold channels 6*a*, 7*a* and 6*b*, 7*b* (see FIG. 4).

As shown in FIG. 2, the nozzle plate 9 has nozzles 10 formed at positions corresponding to the respective holes 12*c* of the manifold plate 7. The nozzle 10 is, by excimer-laser machining a polyimide substrate for example, formed in a shape tapered toward a side at which ink ejection is performed (see FIG. 7).

Ink is supplied from an ink tank (not illustrated) to the ink supply holes 15*a* and 15*b* of the cavity plate 3, and then flows into the both manifold channels 6*a*, 7*a* and 6*b*, 7*b* through the ink supply holes 16*a* and 16*b* formed in the base plate 4. The ink having flown into the manifold channels 6*a*, 7*a* and 6*b*, 7*b* is then distributed to the respective pressure chambers 11 via the holes 13 of the base plate 4, and the recesses 11*c* and the constrictions 11*b* (see FIGS. 3 and 4) formed at the other ends of the pressure chambers 11. The ink thus accommodated in each of the pressure chambers 11 flows through one end 11*a* of each pressure chamber 11 and also through the holes 12*a*, 12*b*, and 12*c* of the base plate 4 and the manifold plates 6 and 7, and then reaches the nozzle 10 of the nozzle plate 10.

In this embodiment, the passage unit 1 is formed of a lamination of the five plates of 3, 4, 6, 7, and 9. In addition, the manifold channels 6*a*, 7*a* and 6*b*, 7*b* are formed in the manifold plate, the pressure chambers 11 and the constriction 11*b* are formed in the cavity plate 3, and the nozzles 10 are formed in the nozzle plate 9. With this construction, the manifold channels 6*a*, 7*a* and 6*b*, 7*b*, pressure chambers 11, the nozzles 10, and the constrictions 11*b* can easily be formed. In particular, the constriction 11*b* and the nozzle 10 having predetermined flow resistances Ra and Rb can efficiently be formed at a low cost.

In this embodiment, particularly, the constrictions 11*b* are formed in the plate 3 in which the pressure chambers 11 are also formed. Thus, the constrictions 11*b* having a predetermined flow resistance Ra can be formed in one operation in which the pressure chambers 11 are also formed, which is effective and economical.

Next, referring to FIG. 4, an actuator unit 2 will be described in detail.

The actuator unit 2 has a layered structure of two piezoelectric sheets 21 and 23 having individual electrodes 28 formed on their surfaces, two piezoelectric sheets 22 and 24 having common electrodes 29 formed on their surfaces, and a piezoelectric sheet 25 having surface electrodes 26 and 27 formed thereon (see FIG. 1) The two piezoelectric sheets 21 and 23 and the two piezoelectric sheets 22 and 24 are alternately put in layers, on which further disposed is the piezoelectric sheet 25. These five piezoelectric sheets 21 to 25 constitute piezoelectric elements, and are all made of a lead zirconate titanate (PZT) having ferroelectricity. Each of the five piezoelectric sheets 21 to 25 has, in a plan view, a substantially rectangular shape that is somewhat smaller than the passage unit 1 (see FIG. 1).

As shown in FIG. 1, many surface electrodes 26 are formed in two rows along a longitudinal direction of the piezoelectric sheet 25. The two rows of the surface electrodes 26 are formed near respective widthwise ends of the piezoelectric sheet 25, respectively. The surface electrodes 27 are formed on both ends of the respective rows of the surface electrodes 26 in the longitudinal direction of the piezoelectric sheet 25.

Figure 4:
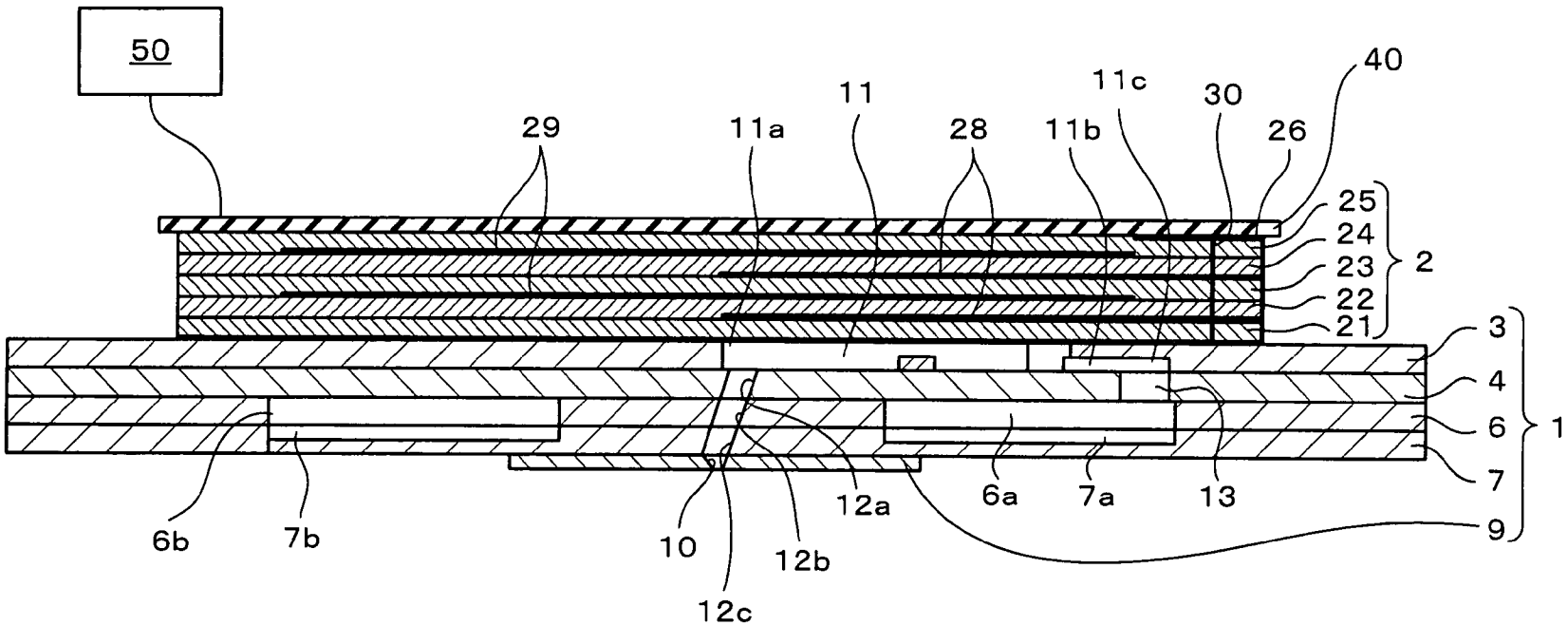
FIG. 4 shows a section taken along a line IV-IV of FIG. 1.

FIG. 4 illustrates only such individual electrodes 28 that correspond to the surface electrodes 26 of one row (nearer to this side in FIG. 1). However, similarly to the surface electrodes 26, the individual electrodes 28 are also formed in two rows along a longitudinal direction of the piezoelectric sheets 21 and 23 (i.e., along a direction perpendicular to the drawing sheet of FIG. 4). The two rows of the individual electrodes 28 are formed near respective widthwise ends of the piezoelectric sheets 21 and 23. More specifically, the individual electrodes 28 extend to the vicinity of a widthwise center of the piezoelectric sheets 21 and 23 so that they can confront the respective pressure chambers 11 (see FIG. 4).

The common electrodes 29 are formed on substantially whole surfaces of the piezoelectric sheets 22 and 24, respectively, so that they can cover an area confronting all the pressure chambers 11.

As shown in FIG. 4, the two individual electrodes 28, which are formed on the piezoelectric sheets 21 and 23, respectively, so that they can be opposed to each other in a vertical direction, are electrically connected through a through hole 30 to their corresponding surface electrode 26 formed on the piezoelectric sheet 25. The through hole 30 is formed in the piezoelectric sheets except the lowermost one, i.e., formed in the piezoelectric sheets 22, 23, 24, and 25. The two common electrodes 29, which are formed on the piezoelectric sheets 22 and 24, respectively, so that they can be opposed to each other in a vertical direction, are electrically connected through a through hole (not illustrated) to the surface electrode 27 (see FIG. 1) formed on the piezoelectric sheet 25. The not-illustrated through hole is formed in the upper three piezoelectric sheets 23, 24, and 25.

The surface electrodes 26 and 27 are connected to a controller (not illustrated) via the FPC 40 and the driver IC 50 (see FIG. 4). The controller performs individual potential controls over each of the surface electrodes 26, whereas the surface electrodes 27 are always kept at the ground potential. As a result, the individual electrodes 28 connected to the surface electrodes 26 are controlled in their potentials independently from one another, and the common electrodes 29 connected to the surface electrodes 27 are always kept at the ground potential.

The piezoelectric sheets 21 to 25 have been polarized in their thickness direction. In the piezoelectric sheets except the lowermost and uppermost piezoelectric sheets 21 and 25, i.e., in the piezoelectric sheets 22, 23, and 24, portions sandwiched between the individual electrodes 28 and the common electrodes 29 act as active portions. In this case, when the individual electrodes 28 are differentiated in their potential from the common electrodes 29 to thereby apply an electric field along a polarization to the active portions of the piezoelectric sheets 22, 23, and 24, the active portions expand or contract in their thickness direction and, by a transversal piezoelectric effect, contract or expand in their plane direction. On the other hand, the lowermost and uppermost piezoelectric sheets 21 and 25 constitute inactive layers having no portion sandwiched between the individual electrodes 28 and the common electrodes 29, and therefore cannot deform by themselves.

Figure 5A:
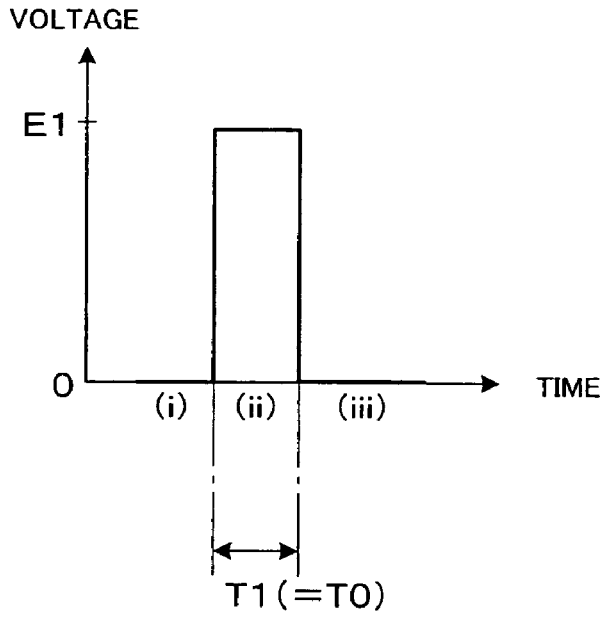
FIG. 5A schematically shows a drive pulse that is applied to an actuator unit in order to eject one ink droplet for one dot.

This embodiment employs, as a drive pulse to be applied to the actuator unit 2, a drive pulse having a rectangular waveform as shown in FIG. 5A so that the actuator unit 2 is driven by a fill-before-fire method. Here, "the fill-before-fire method" is a method to apply negative pressure to ink so that the pressure chambers 11 are filled with ink before the ink ejection and to apply positive pressure to ink at a predetermined timing so that the reflected negative pressure wave and the positive pressure wave cooperate with each other to thereby eject ink, as described detailed below.

The drive pulse shown in FIG. 5A has the voltage of zero during the times (i) and (iii), and the voltage of E1 during the time (ii). A time period T1 during the time (ii) is a pulse width of this drive pulse. T1 is equal to T0 which represents a time required for a pressure wave to propagate in one way longitudinally through the pressure chamber 11.

Here will be described how a state of the actuator unit 2 is changed by application of the drive pulse.

First, before application of the drive pulse (i.e., during the time (i) of FIG. 5A), all the individual electrodes 28 as well as the common electrodes 29 are kept at the ground potential. At this time, the piezoelectric sheets 21 to 25 maintain substantially a flat shape throughout entire regions thereof as shown in FIG. 4. Thus, no ink meniscus protrudes from each nozzle 10, and no ink ejection occurs.

Then, at a proper timing, the drive pulse is applied to the individual electrode 28 that corresponds to a pressure chamber 11 intended to perform an ink ejection (during the time (ii) of FIG. 5A). At this time, the voltage of this individual electrode 28 becomes E1, and portions of the respective piezoelectric sheets 21 to 25 corresponding to this individual electrode 28 as a whole deform into a convex shape protruding toward a side opposite to the pressure chamber 11 (i.e., protruding upward). As a result, the pressure chamber 11 thereunder is increased in volume as compared with in the time (i), so that the pressure chamber 11 incurs a negative pressure wave traveling toward the manifold channels 6*a*, 7*a*; and 6*b*, 7*b*, and at the same time ink is sucked from the manifold channels 6*a*, 7*a* and 6*b*, 7*b* into the pressure chamber 11.

The voltage, which has risen to the predetermined value E1 by the application of the drive pulse, maintains the predetermined value E1 during the time period T1, and then the voltage of the individual electrode 28 returns to zero (in the time (iii) of FIG. 5A). At this time, all the individual electrodes 28 as well as the common electrodes 29 are kept at the ground potential, and the piezoelectric sheets 21 to 25 maintain substantially a flat shape throughout entire regions thereof, which is the same as in the time (i).

At the time of termination of the application of the drive pulse (i.e., at the boundary between the time (ii) and the time (iii)), the volume of the pressure chamber 11 suddenly changes from the increased state into the initial state. Thereby, the pressure chamber 11 incurs a positive pressure wave traveling toward the nozzle 10. This positive pressure is superimposed on another positive pressure wave that results from the negative pressure wave previously caused by the application of the drive pulse having been reflected and reversed at an end of an ink passage of the passage unit 1 (which in this embodiment means an end of the constriction 11*b* near the pressure chamber 11 in FIG. 4). Such a superimposition of pressure waves gives high pressure on ink contained in the pressure chamber 11, so that the ink goes from one end 11*a* of the pressure chamber 11 through the holes 12*a*, 12*b*, and 12*c*, and then is ejected from an end of the nozzle 10.

Figure 5B:
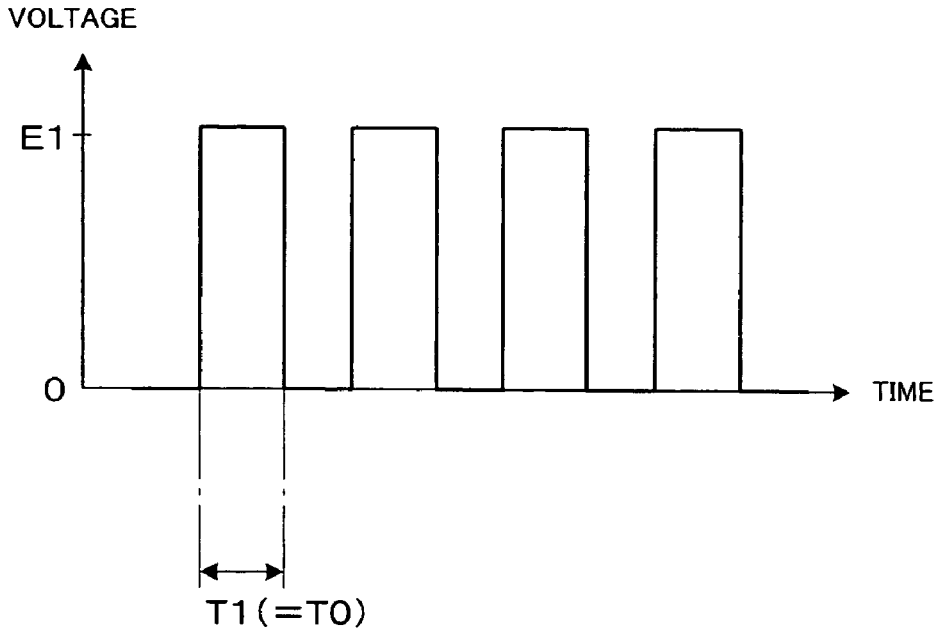
FIG. 5B schematically shows a drive pulse that is applied to the actuator unit in order to eject four ink droplets for one dot.

FIG. 5A shows a drive pulse that is applied to the actuator unit 2 in order to eject a single ink droplet for one dot. However, the ink-jet head 101 is capable of ejecting a plurality of (e.g., two to four) ink droplets for one dot in order to perform gradation printing. FIG. 5B shows drive pulses applied in order to eject four ink droplets for one dot. In this case, four drive pulses are sequentially applied to the actuator unit 2.

In order to examine what effects can be obtained by the ink-jet head of the present invention, experiments have been conducted with changing various parameters such as a construction of the ink passage within the passage unit 1, a frequency of the drive pulse applied to the actuator unit 2, a temperature environment where the head is used, and the like. Results thereof will be described below.

Experimental conditions are as follows. The temperature environment was, in the range of 5 to 45 degrees C., changed by 5 degrees C. The accompanying Table 1 shows ink viscosities u exhibited under the respective temperature environments.

Figure 6:
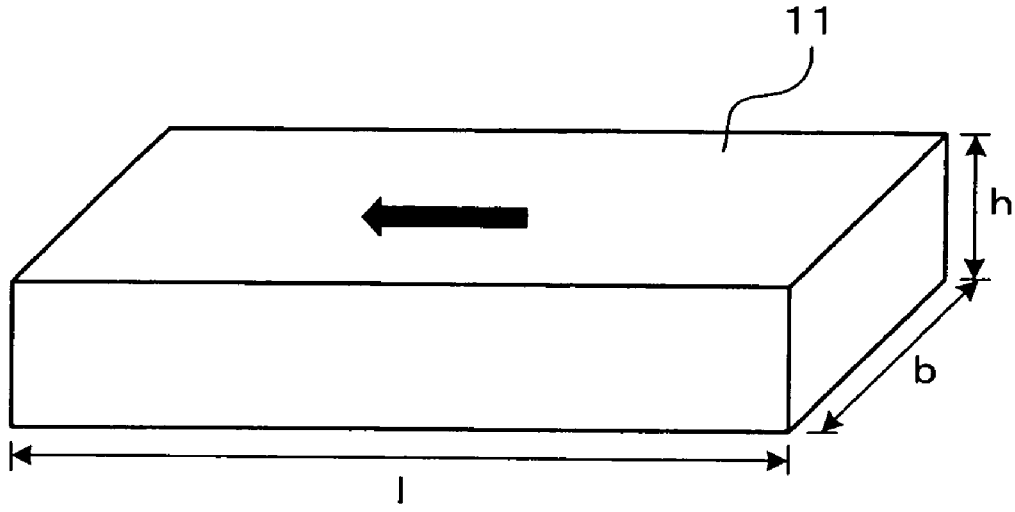
FIG. 6 schematically shows how a space within a pressure chamber is shaped.

A width b and a height h of the pressure chamber 11 (see FIG. 6) were fixed at 250 μm and 40 μm, respectively. A passage length l was changed to 1460 μm, 1960 μm, and 2460 μm which are referred to as types (i), (ii), and (iii), respectively. The accompanying Table 2 shows flow resistances R exhibited in association with the respective types of pressure chambers (i), (ii), (iii). The flow resistance R was calculated out from the equations (1) and (2) indicated below (where ΔP represents a pressure loss, Q represents a flow amount; and r represents an equivalent-radius). The equation (2) is according to the so-called "Poiseuille's Law". The flow resistances R shown in the Table 2 are ones obtained under the temperature of, as an example, 25 degrees C. (which means ones obtained when the ink viscosity μ is 3.2 cps as shown in the Table 1). The same condition is applied to the accompanying Tables 3, 4, and 5.

In an ink passage formed between the pressure chamber 11 and the nozzle 10 (see FIG. 4), that is, in an ink passage constituted by the holes 12*a*, 12*b*, and 12*c* of the respective plates 4, 6, and 7 (which is referred to as a "pressure chamber-nozzle communication path"), the thicknesses of the plates were changed in order to change its passage length l. The accompanying Table 3 shows flow resistances R exhibited in association with the respective types of pressure chamber-nozzle communication paths (i), (ii), (iii).

Figure 7:
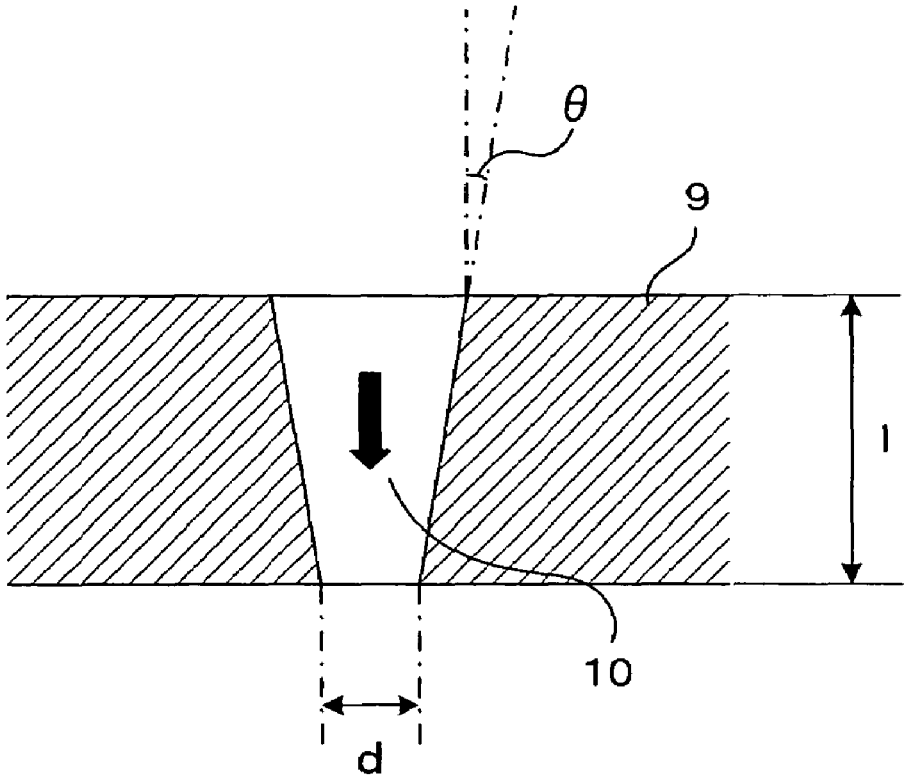
FIG. 7 is a sectional view of a nozzle that is formed in a nozzle plate.

Referring to FIG. 7, a cone angle θ and a passage length l (which equals the thickness of the plate 9) of the nozzle 10 were fixed at 8 degrees and 75 μm, respectively. A diameter d of an ejection port was variously changed, which are referred to as types (i), (ii), (iii), (iv), and (v), respectively. The accompanying Table 4 shows diameters d and flow resistances Rb of the respective types of nozzles (i) to (v).

Figure 8A:
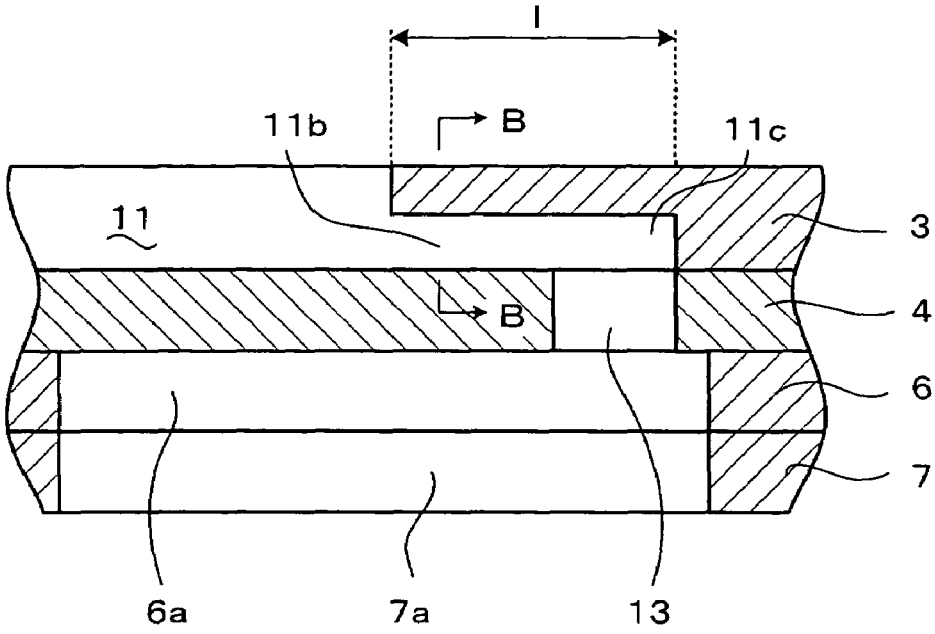
FIG. 8A is a local enlarged view around a constriction illustrated in FIG. 4.
Figure 8B:
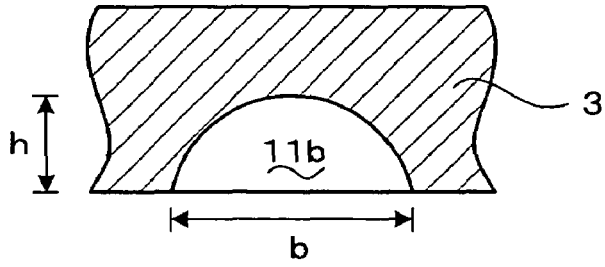
FIG. 8B shows a section taken along a line B-B of FIG. 8A.

A passage length l of the constriction 11*b* shown in FIGS. 8A and 8B was fixed at 550 μm, and a width b and a height h of the constriction 11*b* were changed in such a manner that they can keep a predetermined relationship therebetween. The accompanying Table 5 shows widths b, heights h, and passage resistances Ra of the respective types of constrictions (i) to (iv).

As shown in FIGS. 5A and 5B, a pulse width T1 of the drive pulse applied to the actuator unit 2 was T0 which represents a time required for a pressure wave to propagate in one way longitudinally through the pressure chamber 11. A voltage E1 of the drive pulse was set at such a value that ink may be ejected at a speed of 9 m/s at each temperature. A frequency of the drive pulse was changed within the range of 5 to 96 kHz.

In this way, each part of the ink passage of the passage unit 1 was changed to have plural types in which the flow resistances R were different from one another. These types of the respective parts were variously combined to form heads, and these heads were then examined for ejection stability. The accompanying Table 6 shows, as an example, result of experiments in which the pressure chamber of type (i) and the pressure chamber-nozzle communication path of type (i) were combined. In this Table, the mark of "unstable" was given when ink was ejected in a spraying manner (i.e., in many directions including undesired directions) or when ink was ejected at a significantly low speed or no ejection was done.

It can be seen from the Table 6 that circles, ○, are distributed over a band-like zone. Here, the circle, ○, represents a case where ejection stability was obtained whichever frequency among 24, 12, and 6 kHz was adopted by the drive pulse at a temperature of 5 to 45 degrees C. This shows that constructions of the constriction and the nozzle have a great influence on ejection stability.

The accompanying Table 7 shows ratios Ra/Rb between the flow resistance Ra of the constriction and the flow resistance Rb of the nozzle. The ratios shown in the Table 7 correspond to the respective case shown in the Table 6. It can be seen from the Table 7 that, in this case (where the pressure chamber of type (i) and the pressure chamber-nozzle communication path of type (i) are combined), when the ratio Ra/Rb between the flow resistance Ra of the constriction and the flow resistance Rb of the nozzle falls within the range of 0.48 to 1.26, stable ejection is realized whichever value within the aforementioned ranges are adopted as the frequency of the drive pulse and as the temperature environment where the head is used.

Figure 9:
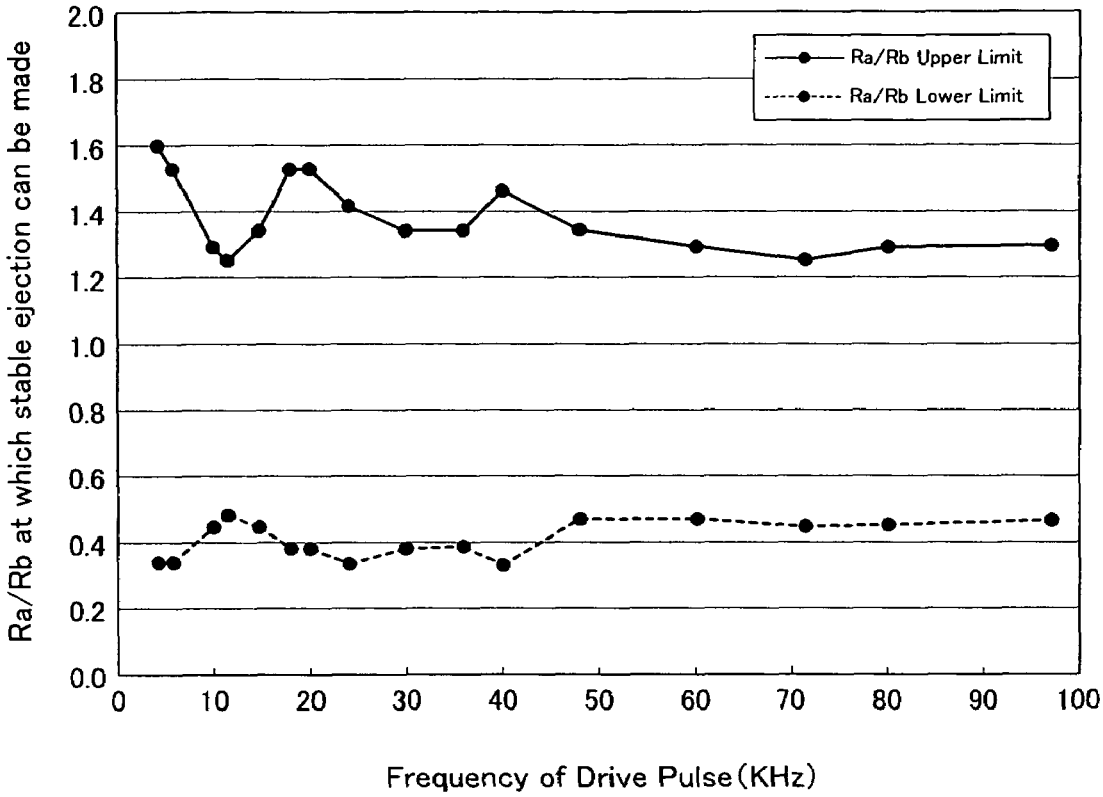
FIG. 9 shows a graph in which upper and lower limits of Ra/Rb within which stable ejection can be made are plotted against what frequency between 5-96 kHz is adopted by a drive pulse, where Ra/Rb represents a ratio between a flow resistance Ra of the constriction and a flow resistance Rb of the nozzle.

Further, the accompanying Table 8 and FIG. 9 show upper and lower limits of the ratio Ra/Rb between the flow resistance Ra of the constriction and the flow resistance Rb of the nozzle, within which stable ejection can be made, in association with various frequencies of the drive pulse within the range of 5 to 96 kHz.

It can be seen from the Table 8 and FIG. 9 that the upper limit and the lower limit of Ra/Rb become minimum (0.48) and maximum value (1.26) when the frequency of the drive pulse was 12 kHz.

The data shown in the Tables 6 to 8 and FIG. 9 are associated with the combination of the pressure chamber of type (i) and the pressure chamber-nozzle communication path of type (i). However, when they were combined otherwise, almost the same data were obtained. That is, in all the combination of the pressure chamber types (i) to (iii) and the communication path types (i) to (iii), the values of Ra/Rb which allowed stable ejection were almost the same.

Seen from the above-described experimental results are that, when the ratio between the flow resistance Ra of the constriction 11*b* and the flow resistance Rb of the nozzle 10 falls within the range of 0.48 to 1.26, stable ejection can be realized even if the drive pulse applied to the actuator unit 2 adopts various frequencies and the head is used under various temperature environments. The Ra/Rb is preferably 0.63 to 1.05 and more preferably 0.8 to 1.0, because good ejection stability can be maintained even though a design error has occurred, a temperature goes beyond a set value, or any other troubles occurs.

Ejection stability becomes poor when the Ra/Rb is out of the aforesaid range, supposedly because ink supply to the pressure chamber 11 via the constriction 11*b* and ink ejection from the nozzle 10 becomes unbalanced. Assumedly, to be more specific, there arises the following phenomenon. The amount of ink that is supplied from the manifold channels 6*a*, 7*a* and 6*b*, 7*b* to the pressure chamber 11 via the constriction 11*b* becomes insufficient when the Ra/Rb exceeds the upper limit 1.26, and becomes too large when the Ra/Rb is lower than the lower limit 0.48. When too large amount of ink is supplied to the pressure chamber 11, a meniscus formed at the end of the nozzle 10 is excessively protruded out, to cause a trouble such as spray-like ejection of extra ink. When ink supply to the pressure chamber 11 is insufficient, the meniscus takes a shape that is pulled toward the inside of the nozzle 10, and at the same time extra air enters the pressure chamber 11 so that pressure required for ejection is absorbed by the extra air with the result of possible troubles such as significantly reduced speed of ink ejection, impossibility of ejection, or the like.

The present invention is not limited to the above-described embodiment but can be applied to various ink-jet heads, insofar as the head comprises an ink chamber that contains ink, a pressure chamber to which ink is supplied from the ink chamber, an actuator that is applied with a drive pulse to thereby change the pressure of ink in the pressure chamber, a constriction that is disposed between the ink chamber and the pressure chamber and has a passage width narrower than that of the pressure chamber, and a nozzle that communicates with the pressure chamber and ejects ink in association with the pressure change of the ink in the pressure chamber. For example, a modification as described below is also acceptable.

The half-etching process may not necessarily be adopted in order to form the constriction 11*b*.

The passage unit 1 of the head may not always have a layered structure of the plate-shaped materials 3, 4, 6, 7, and 9. For example, there may also be adopted a single body in which formed is a space that defines an ink passage (i.e., a space including an ink chamber, a pressure chamber, a constriction, and a nozzle).

The ink passage formed within the head can variously be changed in shape, size, or the like. For example, the nozzle 10 may not have a tapered shape (i.e., θ=0)

A material of the uppermost piezoelectric sheet 25 is not limited to the PZT having ferroelectricity, but the uppermost piezoelectric sheet 25 may be made of a material having low dielectricity or insulating property, because in such a case voltage application to the surface electrodes 26 and 27 does not cause unnecessary deformation. However, in consideration of integral forming, it is preferable that the uppermost piezoelectric sheet 25 is, similarly with the other piezoelectric sheets 21 to 24, made of the PZT.

The waveform of the drive pulse applied to the actuator unit 2, which is shown in FIGS. 5A and 5B, may be inverted.

A method for driving the actuator unit 2 is not limited to the above-described one in which the piezoelectric sheets maintains a flat shape in the normal state, and their active portions are deformed into a convex shape toward a side opposite to the pressure chamber by application of the drive pulse, and then the sheets restores the original flat shape to thereby eject ink. For example, piezoelectric sheets maintains a flat shape in the normal state, and their active portions are deformed into a convex shape toward the pressure chamber side by application of the drive pulse so that the volume of the pressure chamber is reduced to thereby eject ink. Thereafter, the sheets restores the original flat shape and thus ink is supplied to the pressure chamber. Alternatively, in the normal state active portions of piezoelectric sheets are kept deformed into a convex shape toward the pressure chamber side, and then the piezoelectric sheets are flattened by application of a drive pulse so that the volume of the pressure chamber is increased, and then the active portions are again deformed into a convex shape toward the pressure chamber side so that the pressure chamber restores the original small volume to thereby eject ink.

A frequency of the drive pulse is not limited to 5 to 96 kHz.

Although, in the above-described embodiment, the common electrodes are always kept at zero (V), this is not limitative.

Although, in the above-described embodiment, the actuator unit 2 having piezoelectric elements is used, an actuator having a thermo-electric conversion element, an electrostatic actuator or the like may be used instead of the piezoelectric actuator unit 2.

The ink-jet head of the present invention is not limited to the use in printers, but applicable to ink-jet type facsimile or copying machine.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

TABLE 1

| | TEMPERATURE(° C.) | | | | | | | | |
|---|---|---|---|---|---|---|---|---|---|
| | 5 | 10 | 15 | 20 | 25 | 30 | 35 | 40 | 45 |
| VISCOSITY μ (cps) | 6.6 | 5.6 | 4.1 | 3.6 | 3.2 | 2.8 | 2.4 | 2.1 | 1.9 |

TABLE 2

| | TYPE OF PRESSURE CHAMBER | | |
|---|---|---|---|
| | (i) | (ii) | (iii) |
| FLOW RESISTANCE(Mpa · s/cm$^3$) | 3.14 | 4.22 | 5.30 |

$$R = \frac{\Delta P}{Q} \quad \text{[EQUATION 1]}$$

$$Q = \frac{\Delta P \cdot \pi \cdot r^4}{8\mu \cdot l} \quad \text{[EQUATION 2]}$$

TABLE 3

| | TYPE OF PRESSURE CHAMBER-NOZZLE COMMUNICATION PATH | | |
|---|---|---|---|
| | (i) | (ii) | (iii) |
| FLOW RESISTANCE R(Mpa · s/cm$^3$) | 0.053 | 0.074 | 0.091 |

TABLE 4

| | TYPE OF NOZZLE | | | | |
|---|---|---|---|---|---|
| | (i) | (ii) | (iii) | (iv) | (v) |
| DIAMETER OF EJECTION PORT d(μm) | 18 | 19 | 20 | 21 | 22 |
| FLOW RESISTANCE Rb(Mpa · s/cm$^3$) | 24.28 | 20.41 | 17.30 | 14.78 | 12.72 |

TABLE 5

| | TYPE OF CONSTRICTION | | | | | | | | |
|---|---|---|---|---|---|---|---|---|---|
| | (i) | (ii) | (iii) | (iv) | (v) | (vi) | (vii) | (viii) | (ix) |
| WIDTH b(μm) | 83.0 | 85.0 | 87.0 | 89.0 | 91.0 | 93.0 | 95.0 | 97.0 | 99.0 |
| HEIGHT h(μm) | 21.3 | 22.9 | 24.5 | 26.1 | 27.7 | 29.4 | 31.0 | 32.6 | 34.2 |
| FLOW RESISTANCE Ra(MPa · s/cm$^3$) | 32.69 | 26.49 | 21.76 | 18.10 | 15.21 | 12.91 | 11.04 | 9.52 | 8.26 |

TABLE 6

| TYPE OF CONSTRICTION | TYPE OF NOZZLE (i) | (ii) | (iii) | (iv) | (v) |
|---|---|---|---|---|---|
| (i) | Δ | x | x | x | x |
| (ii) | ○ | Δ | Δ | x | x |
| (iii) | ○ | ○ | ○ | Δ | x |
| (iv) | ○ | ○ | ○ | ○ | Δ |
| (v) | ○ | ○ | ○ | ○ | ○ |
| (vi) | ○ | ○ | ○ | ○ | ○ |
| (vii) | Δ | ○ | ○ | ○ | ○ |
| (viii) | x | Δ | ○ | ○ | ○ |
| (ix) | x | x | ○ | ○ | ○ |

○: Ejection stability was obtained whichever frequency among 24, 12, and 6 kHz was adopted by the drive pulse at temperature of 5 to 45 degrees C.

Δ: Ejection became unstable when the drive pulse adopted any of the frequencies among 24, 12, and 6 kHz at a temperature of 35 degrees C. or higher (Ejection was stable at a temperature of less than 35 degrees C.)

x: Ejection became unstable when the drive pulse adopted any of the frequencies among 24, 12, and 6 kHz at a temperature of 25 degrees C..

TABLE 7

| TYPE OF CONSTRICTION | TYPE OF NOZZLE (i) | (ii) | (iii) | (iv) | (v) |
|---|---|---|---|---|---|
| (i) | 1.35 | 1.60 | 1.89 | 2.21 | 2.57 |
| (ii) | 1.09 | 1.30 | 1.53 | 1.79 | 2.08 |
| (iii) | 0.90 | 1.07 | 1.26 | 1.47 | 1.71 |
| (iv) | 0.75 | 0.89 | 1.05 | 1.22 | 1.42 |
| (v) | 0.63 | 0.75 | 0.88 | 1.03 | 1.20 |
| (vi) | 0.53 | 0.63 | 0.75 | 0.87 | 1.01 |
| (vii) | 0.45 | 0.54 | 0.64 | 0.75 | 0.87 |
| (viii) | 0.39 | 0.47 | 0.55 | 0.64 | 0.75 |
| (ix) | 0.34 | 0.40 | 0.48 | 0.56 | 0.65 |

Flow resistance Ra of constriction/Flow resistance Rb of nozzle

TABLE 8

| FREQUENCY OF DRIVE PULSE (kHz) | Ra/Rb UPPER LIMIT | Ra/Rb LOWER LIMIT |
|---|---|---|
| 5 | 1.60 | 0.34 |
| 6 | 1.53 | 0.34 |
| 10 | 1.30 | 0.45 |
| 12 | 1.26 | 0.48 |
| 15 | 1.35 | 0.45 |
| 18 | 1.53 | 0.39 |

TABLE 8-continued

| FREQUENCY OF DRIVE PULSE (kHz) | Ra/Rb UPPER LIMIT | Ra/Rb LOWER LIMIT |
|---|---|---|
| 20 | 1.53 | 0.39 |
| 24 | 1.42 | 0.34 |
| 30 | 1.35 | 0.39 |
| 36 | 1.35 | 0.40 |
| 40 | 1.47 | 0.34 |
| 48 | 1.35 | 0.47 |
| 60 | 1.30 | 0.48 |
| 72 | 1.26 | 0.45 |
| 80 | 1.30 | 0.45 |
| 96 | 1.30 | 0.47 |

What is claimed is:

1. An ink-jet head comprising:

an ink chamber that contains ink;

a pressure chamber to which ink is supplied from the ink chamber;

an actuator that is applied with a drive pulse to thereby change the pressure of ink in the pressure chamber;

a constriction that is disposed between the ink chamber and the pressure chamber and has a passage width narrower than that of the pressure chamber; and a nozzle that communicates with the pressure chamber and ejects ink in association with the pressure change of the ink in the pressure chamber, wherein a ratio Ra/Rb between a flow resistance Ra of the constriction and a flow resistance Rb of the nozzle is 0.48 to 1.26.

2. The ink-jet head according to claim 1, wherein the actuator is disposed on the pressure chamber and is deformed by a drive pulse applied thereto to thereby change the volume of the pressure chamber.

3. The ink-jet head according to claim 1, wherein the actuator is driven to apply negative pressure to ink so that the pressure chamber is filled with ink and to apply positive pressure to ink at a predetermined timing so that the reflected negative pressure wave and the positive pressure wave cooperate with each other to thereby eject ink.

4. The ink-jet head according to claim 1, wherein the ratio Ra/Rb between a flow resistance Ra of the constriction and a flow resistance Rb of the nozzle is 0.8 to 1.0.

5. The ink-jet head according to claim 1, wherein a frequency of the drive pulse is 5 to 96 kHz.

6. The ink-jet head according to claim 1, wherein the constriction is formed through a half-etching process.

7. The ink-jet head according to claim 1, having a layered structure of a plurality of plate-like materials.

8. The ink-jet head according to claim 1, wherein the constriction is formed in a member in which the pressure chamber is also formed.

* * * * *